United States Patent [19]

Münch et al.

[11] Patent Number: 4,971,835

[45] Date of Patent: Nov. 20, 1990

[54] PROCESSING FOR RENDERING LEATHER HYDROPHOBIC AND OLEOPHOBIC BY IMPREGNATION WITH FLUORO CHEMICALS

[75] Inventors: Norbert Münch, Kelkheim; Lothar Schlösser, Frankfurt am Main; Gustav Hudec, Schwalbach am Taunus, all of Fed. Rep. of Germany

[73] Assignee: Hoecsht Aktiengesellschaft, Frankfurt am Main, Fed. Rep. of Germany

[21] Appl. No.: 235,037

[22] Filed: Aug. 22, 1988

[30] Foreign Application Priority Data

Aug. 24, 1987 [DE] Fed. Rep. of Germany ..... 37281623

[51] Int. Cl.[5] ..... B05D 1/02; B05D 1/18

[52] U.S. Cl. ..... 427/421; 427/389; 427/393.4; 427/430.1; 428/421; 428/473

[58] Field of Search ..... 427/389, 393.4, 421, 427/430.1; 428/421, 473

[56] References Cited

U.S. PATENT DOCUMENTS

| | | | |
|---|---|---|---|
| 3,331,701 | 7/1967 | Gagliardi | 427/389 X |
| 3,518,114 | 6/1970 | Pittman et al. | 427/389 |
| 3,666,538 | 5/1972 | Domba | 427/389 X |

*Primary Examiner*—Michael Lusigman

[57] ABSTRACT

The leather is treated with a resin, quaternary ammonium compound, amine or polymer before the impregnation with the fluoro chemicals. With these auxiliaries, a uniform effectiveness of the fluoro chemicals which act on the surface is achieved, regardless of the procedure or the chemicals previously introduced into the leather. These auxiliaries can optionally also be applied to the leather together with the fluoro chemicals.

21 Claims, No Drawings

PROCESSING FOR RENDERING LEATHER HYDROPHOBIC AND OLEOPHOBIC BY IMPREGNATION WITH FLUORO CHEMICALS

DESCRIPTION

The invention relates to a process which increases the effectiveness of fluoro chemicals used for rendering leather simultaneously hydrophobic and oleophobic. The process can be used before or during any operation after tanning, but preferably after acidification. The process can be used on leather which has been intermediately dried and on leather which has not been intermediately dried (directly worked leather).

For some years a trend towards little top finishing, or none at all, of all types of leather, in particular clothing, furniture and shoe upper leather has become apparent. Leather with a natural surface, a natural grain appearance and a pleasant handle is thereby obtained. A serious disadvantage of less or an absence of top finishing is that the easy care properties of this leather are substantially reduced. The top finish which protects the leather is completely or partly absent.

Reduced easy care properties manifest themselves, for example, in an increased water absoration, in the formation of water spots and in a greatly increased soilability.

These disadvantages can be compensated by increasing the oleophobicity and hydrophobicity with the aid of impregnating fluoro chemicals.

A number of impregnating chemicals are available on the market, and their action is subdivided into five classes:

1. Impregnation by infiltration of water-insoluble substances, such as solid fats, waxes or polymers.

These substances reduce the permeability to air and water vapor and hence the wearing comfort of clothing and shoe upper leather.

2. Impregnation by infiltration of water-swelling substances, such as dicarboxylic acid derivatives (for example alkylsuccinic acid), partial esters of polyalcohols (for example sorbitan monooleate), fatty alcohols and fatty acids with a low degree of ethoxylation and sulfoxidized paraffin sludge.

These substances are so-called water-in-oil emulsifiers.

3. Impregnation by anionic products, such as, for example, fatty acids, which form hydrophobic metal soaps with polyvalent metal ions, such as, for example, $Ca^{2+}$, $Cr^{3+}$or $Al^{3+}$.

4. Impregnation by complexing emulsifiers which undergo coordinative bonding with the chromium of the tanning agent, for example monoalkyl phosphates and monoalkyl citrates.

5. Impregnation with chlorine-containing products which do not have to be after-treated with polyvalent metal ions, for example fluorinated addition compounds.

There are differences between the products mentioned under No. 1 to 4 and the products of No. 5:

The products 1 to 4 infiltrate into the fiber interstices (closed impregnation), whereas the products under No. 5 envelope the fibers (open impregnation).

The permeability to water vapor and air are thereby retained with open impregnation.

The products 1 to 4 do not improve the oleophobicity, whereas a considerable advantage of the products under No. 5 is a marked increase in the oleophobicity of the leather. The greater the oleophobicity of leather, the greater its soil-repellency.

The products 1 to 4 infiltrate over the entire cross-section of the leather, whereas the products under No. 5 preferentially display their action on the surface of the leather. The effectiveness of such fluorinated impregnating chemicals acting on the surface of the leather is influenced by the procedure and by the chemicals introduced into the leather.

The object of the invention was therefore to discover auxiliaries which guarantee a uniform effectiveness of the fluorinated impregnating chemicals acting on the surface, regardless of the procedure or of the chemicals previously introduced into the leather.

A process has now been found for rendering leather hydrophobic and oleophobic by impregnation with fluoro chemicals, which comprises treating the leather with resins, quaternary ammonium compounds, amines or polymers before or at the same time as the impregnation with the fluoro chemicals. If these products are used before or together with the fluoro chemicals, the effectiveness of these fluoro chemicals is increased and is no longer influenced by the procedure or by the chemicals previously introduced into the leather.

Possible resins for this process are condensation products of formaldehyde with melamine (molar ratio 3:1 to 12:1, preferably 4:1 to 6:1), dicyandiamine (molar ratio 1:1 to 3:1), urea (molar ratio 1:1 to 3:1, preferably 1.5:1 to 2.8:1), phenol (molar ratio 0.5:1 to 2:1), naphthol (molar ratio 0.5:1 to 2:1) and aromatic sulfonic acids, preferably naphthalenesulfonic acid (molar ratio 3:1 to 12:1, preferably 5:1 to 8:1).

Possible quaternary ammonium compounds are compounds of the formula $$R_4-\overset{\oplus}{N}(R_1)(R_3)-R_2 \quad A^{\ominus}$$

in which $R_1$ and $R_2$ are identical or different and denote $C_1$–$C_{20}$-alkyl or $C_{2-C20}$-alkenyl, $R_3$ and $R_4$ are identical or different and denote $C_1$–$C_4$-alkyl or benzyl and denotes an anion, such as, for example, chloride, methosulfate or methophosphate.

Possible amines are compounds of the following formulae $$H_2N-R_5,\ HN(R_6)-R_5 \text{ and } R_6-N(R_7)-R_5$$

in which $R_5$ denotes $C_7$–$C_{20}$-alkyl or $C_7$–$C_{20}$-alkenyl, $R_6$ denotes $C_1$–$C_{20}$-alkyl, $C_2$–$C_{20}$-alkenyl or benzyl and $R_7$ denotes $C_1$–$C_4$-alkyl or benzyl.

Possible polymeric compounds are polymers which can be polymerized from the following monomers in various proportions:

acrylic acid and the methyl, ethyl, propyl, butyl, hexyl, methylhexyl and octadecyl ester thereof, methacrylic acid and the methyl, ethyl, propyl, butyl, hexyl, methylhexyl and octadecyl ester thereof, acrylamide, acrylonitrile, vinyl acetate, ethylene, styrene and maleic anhydride.

Maleic acid, maleic acid mono- and diesters, N-vinyl-Nmethylacetamide, acrylamidomethylene-propylsulfonate, vinylformamide, glycidyl methacrylate and diallyldimethylammonium chloride.

The molecular weights of these polymers are in the range from 2000 to 50,000, preferably 5000 to 20,000. Polymers of 60 to 80% of vinyl acetate and 20 to 40% of ethylene or 30 to 60% of styrene and 40 to 70% of maleic anhydride are preferred.

Possible fluorine-containing impregnating chemicals are: fluorocarbon resins, fluorinated addition, polymerization and condensation products, perfluorinated urethanes, ureas, esters, sulfonamides, carbamides, amines, carboxylic acids and alcohols, fluorinated alkyl and aryl compounds and oxyethylated perfluoroalcohols.

Reaction products which are prepared from the following compounds are preferably suitable: perfluoroalkylethanol and alkyl or phenyl isocyanates; perfluoroalkylethanol with epichlorohydrin and alkyl or phenyl isocyanates; and polymeric perfluoroacrylates. The perfluoroalkyl groups usually contain 4 to 16 carbon atoms.

The abovementioned resins, quaternary ammonium compounds, amines or polymers can be applied to the leather either together with the fluoro chemicals or in a separate treatment stage after tanning, preferably after acidification. The amount of these compounds is 0.05 to 10% by weight, based on the shaved weight, or 0.1 to 20% by weight, based on the dry weight. The leather is treated with the fluoro chemicals and the auxiliaries mentioned in the customary manner by impregnation with a solution, emulsion or dispersion of the products mentioned in either one or two steps, as described above. This impregnation is effected by spraying, in a dipping bath, in a vat, in a mixer or in a winch. The process according to the invention can also be combined with plumping impregnation which closes the fiber interstices, as mentioned above.

EXAMPLE 1

| | | |
|---|---|---|
| Starting material: | Chrome-tanned, retanned and fat-liquored crust; the % data relate to the dry weight of the leather | |
| | 1000.0% of water at 45° C. | |
| | 2.0% of 25% strength ammonia | |
| | | 2 h milling |
| | new liquor | |
| | 400.0% of water at 45° C. | |
| | 1.0% of a condensation product of formaldehyde and β-naphthalenesulfonic acid | |
| | 2.0% of dyestuff | |
| | | 1 h milling |
| Addition: | 1.5% of 85% strength formic acid | |
| | | 20 min milling |
| | new liquor | |
| | 400.0% of water at 45° C. | |
| | 2.0% of dyestuff | |
| | | 30 min milling |
| Addition: | 0.5% of 85% strength formic acid | |
| | | 20 min milling |
| | new liquor | |
| | 400.0% of water at 45° C. | |
| | 0.5% of 85% strength formic acid | |
| | 1.0% of a condensation product of formaldehyde with dicyandiamine (44%) | |
| | 4.0% of fluorinated impregnating agent (17% strength in active compound) | |
| | | 20 min milling |
| | rinsing, tensioning, | |

-continued

| | | |
|---|---|---|
| | drying (50° C.), milling | |

EXAMPLE 2

| | | |
|---|---|---|
| Starting material: | Shaved chrome leather; the % data relate to the shaved weight | |
| | 200.0% of water at 50° C. | |
| | 1.0% of sodium bicarbonate | |
| | 1.0% of sodium formate | |
| | | 1 h milling |
| | new liquor | |
| | 100.0% of water at 50° C. | |
| | 3.0% of glutaric dialdehyde | |
| | | 1 h milling |
| Addition: | 5.0% of fat liquor | |
| | | 30 min milling |
| | new liquor | |
| | 100.0% of water at 50° C. | |
| | 5.0% of styrene-maleic anhydride condensation product (50% strength) | |
| | | 15 min milling |
| Addition: | 5.0% of styrene-maleic anhydride condensation product (50% strength) | |
| | | 15 min milling |
| Addition: | 0.5% of dyestuff | |
| | | 30 min milling |
| Addition: | 1.0% of formic acid (85% strength) | |
| | | 30 min milling |
| | new liquor | |
| | 100.0% of water at 60° C. | |
| | 3.0% of fat liquor | |
| | | 30 min milling |
| | new liquor | |
| | 100.0% of water at 45° C. | |
| | 0.5% of vinyl acetate/ethylene copolymer dispersion (50%) | |
| | | 30 min milling |
| Addition: | 2.0% of fluorinated impregnating agent (17% strength in active compound) | |
| | finishing in the manner customary in industry | |

EXAMPLE 3

| | | |
|---|---|---|
| Starting material: | Chrome-tanned, retanned and fat-liquored crust; the % data relate to the dry weight of the leather | |
| | 1000.0% of water at 50° C. | |
| | 2.0% of ammonia (25% strength) | |
| | | 2 h milling |
| | new liquor | |
| | 400.0% of water at 45° C. | |
| | 1.0% of a condensation product of formaldehyde and β-naphthalenesulfonic acid | |
| | 10.0% of a condensation product of formaldehyde and 4,4'-dihydroxydiphenylsulfone and phenol (95% strength) | |
| | | 30 min milling |
| Addition: | 2.0% of dyestuff | |
| | | 1 h milling |
| Addition: | 2.5% of formic acid (85% strength) | |
| | | 20 min milling |
| | new liquor | |
| | 400.0% of water at 45° C. | |
| | 2.0% of dyestuff | |
| | | 30 min milling |
| Addition: | 0.5% of formic acid (85% strength) | |
| | | 20 min milling |
| | new liquor | |
| | 400.0% of water at 45° C. | |
| | 0.5% of 85% strength formic acid | |
| | | 10 min milling |
| Addition: | 1.0% of dimethyldistearylammonium chloride | |
| | 4.0% of fluorinated impregnating agent (17% strength in active compound) | |
| | | 20 min milling |

-continued

| finishing in the manner customary in industry |
|---|

We claim:

1. A process for rendering leather hydrophobic and oleophobic by impregnation with fluoro chemicals, which comprises treating the leather with non-fluorinated resins, quaternary ammonium compounds, or amines before or at the same time as the impregnation with the fluoro chemicals wherein the non-fluorinated resins, quaternary ammonium compounds, amines are used in an amount of 0.05 to 10% by weight, based on the shaved weight, or 0.1 to 20% by weight, based on the dry weight.

2. The process of claim 1, wherein said non-fluorinated resins are condensation products of formaldehyde with urea at a molar ratio of 1:1 to 3:1.

3. The process as claimed in claim 1, wherein the impregnation with the fluoro chemicals and the auxiliaries is combined with a plumping impregnation which closes the fiber interstices.

4. The process of claim 1, wherein said non-fluorinated resins are condensation products of formaldehyde with melamine at a molar ratio range of 3:1 to 12:1.

5. The process of claim 4, wherein said non-fluorinated resins are condensation products of formaldehyde with melamine at a molar ratio range of 4:1 to 6:1.

6. The process of claim 1, wherein said non-fluorinated resins are condensation products of formaldehyde with dicyandiamine at a molar ratio range of 1:1 to 3:1.

7. The process of claim 6, wherein said non-fluorinated resins are condensation products of formaldehyde with urea at a molar ratio orange of 1:5:1 to 2:8:1.

8. The process of claim 1, wherein said non-fluorinated resins are condensation products of formaldehyde with phenol or naphthol at a molar ratio range of 0:5:1 to 2:1.

9. The process of claim 1, wherein said non-fluorinated resins are condensation products of formaldehyde with an aromatic sulfonic acid in a molar ratio range of 3:1 to 12:1.

10. The process of claim 1, wherein said non-fluorinated resins are condensation products of formaldehyde with an aromatic sulfonic acid in a molar range of 5:1 to 8:1.

11. The process of claim 9, wherein said aromatic sulfonic acid is naphthalenesulfonic acid.

12. The process of claim 10, wherein said aromatic sulfonic acid is naphthalenesulfonic acid.

13. The process of claim 1, wherein said quaternary ammonium compounds are compounds of the formula

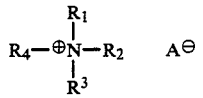

wherein $R_1$ and $R_2$ are identical or different, and denote $C_1$–$C_{20}$-alkyl, or $C_2$–$C_{20}$-alkenyl, $R_3$ and $R_4$ are identical or different and denote $C_1$–$C_4$ -alkyl or benzyl and $A^{\ominus}$ denotes an anion.

14. The process of claim 13, wherein said anion is chloride methosulfate or methophosphate.

15. The process of claim 1, wherein said amines are of the formulae

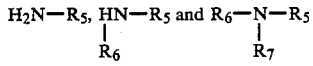

wherein $R_5$ denotes $C_7$–$C_{20}$-alkyl or $C_7$–$C_{20}$-alkenyl, $R_6$ denotes $C_1$–$C_{20}$-alkyl, $C_2$–$C_{20}$-alkenyl or benzyl and $R_7$ denotes $C_1$–$C_4$ -alkyl or benzyl.

16. The process of claim 1, wherein said non-fluorinated resins are compounds which can be polymerized from monomers consisting of acrylic acid, and the methyl, ethyl, propyl, butyl, hexyl, methylhexyl, and octadecyl ester thereof; methacrylic acid and the methyl, ethyl, propyl, butyl, hexyl, methylhexyl and octadecyl ester thereof; acrylamide, acrylonitrile, vinyl acetate, ethylene, styrene, and maleic anhydride; maleic acid, maleic acid mono-and diesters, N-vinyl-N-methylacetamide, acrylamindomethylene-propylsulfonate, vinylformamide, glycidyl methacrylate and diallyldimethylammonium chloride.

17. The process of claim 16 wherein said non-fluorinated resins have molecular weights in the range of 2000 to 50,000.

18. The process of claim 16 wherein said non-fluorinated resins have molecular weights in the range of 5,000 to 20,000.

19. The process of claim 16, wherein said non-fluorinated resins one of 60 to 80% vinyl acetate and 20 to 40% ethylene.

20. The process of claim 16, wherein said non-fluorinated resins are 30 to 60% styrene and 40 to 70% maleic anhydride.

21. The process of claim 1 wherein said fluoro chemicals are selected from the list consisting of fluorocarbon resins, fluorinated addition, polymerization and condensation products, perfluorinated urethanes, ureas, esters, sulfonamides, carbamides, amines, carboxylic acids and alcohols, fluorinated alkyl and aryl compounds and oxyethylated perfluoroalcohols.

* * * * *